US005266184A

United States Patent [19]

Roder

[11] Patent Number: 5,266,184

[45] Date of Patent: Nov. 30, 1993

[54] PROCESS FOR INCREASING PITCH YIELD FROM COAL TAR

[75] Inventor: William R. Roder, Indianapolis, Ind.

[73] Assignee: Reilly Industries, Inc., Indianapolis, Ind.

[21] Appl. No.: 832,425

[22] Filed: Feb. 7, 1992

[51] Int. Cl.[5] ..... C10C 1/00; C10C 1/20; C10C 1/04

[52] U.S. Cl. ..... 208/22; 208/42; 208/44; 201/20

[58] Field of Search ..... 208/22, 42, 44; 201/20; 423/447.4

[56] References Cited

U.S. PATENT DOCUMENTS

| | | | |
|---|---|---|---|
| 2,764,523 | 9/1956 | Cottle et al. | 208/22 |
| 3,031,803 | 1/1967 | Schick et al. | 208/44 |
| 3,275,585 | 9/1966 | Baum et al. | 208/44 |
| 3,509,038 | 4/1970 | Corbett | 208/22 |
| 3,615,802 | 10/1971 | Betty, Jr. et al. | 106/280 |
| 4,179,550 | 12/1979 | Miyamoto et al. | 208/62 |
| 4,670,129 | 6/1987 | Tate et al. | 208/22 |
| 4,793,912 | 12/1988 | Tate et al. | 106/273.1 |
| 4,801,372 | 1/1989 | Tate et al. | 423/447.4 |
| 4,874,502 | 10/1989 | Tsuchitani et al. | 423/447.4 |
| 4,921,539 | 5/1990 | Harlin et al. | 106/284.03 |

*Primary Examiner*—Theodore Morris
*Assistant Examiner*—P. L. Hailey
*Attorney, Agent, or Firm*—Woodard, Emhardt, Naughton Moriarty & McNett

[57] ABSTRACT

Described is a preferred process for obtaining an increased pitch yield from the distillation of crude coal tar material. The process includes treating a crude coal tar material by reaction with formaldehyde, followed by distillation of the coal tar to afford a yield of coal tar pitch which is significantly increased over that obtained without the formaldehyde treatment.

13 Claims, No Drawings

PROCESS FOR INCREASING PITCH YIELD FROM COAL TAR

BACKGROUND

The Present invention generally relates to the processing of crude coal tar to separate and recover valuable chemicals and compositions therefrom. More particularly, the present invention relates to a process for obtaining an increased yield of coal tar pitch from the distillation of a crude coal tar material, and to the pitch product thus obtained.

As general background, the destructive, dry distillation or carbonization of coal yields a liquid condensate, most of which is coal tar. Usually, the coal tar amounts to some 3% of the coal, and is a dark, thick liquid or semi-solid at ambient temperatures. This coal tar includes a mixture of aromatic hydrocarbons such as benzene, toluene, naphthalene, anthracene, xylene and others, phenol bodies such as phenol, cresols, xylenols and others, ammonia, and pyridine and other organic bases, etc.

Upon redistillation of coal tar, several aromatic fractions are obtained usually boiling at temperatures up to about 360° C. These fractions can be further processed by distillation, extraction or other techniques to recover individual or mixed components in a more purified form.

As an example, in an initial phase, ammonia and other gases are separated from crude tar after which the tar is distilled in an operation termed "topping" to separate a first fraction containing certain chemical substituents from higher boiling, more viscous constituents. The distillate from topping commonly termed "chemical oil", has an upper boiling point of about 250° C. and contains tar acids (i.e. the phenolic bodies), naphthalene and tar bases including pyridine and others.

The tar acids usually constitute about 1 to 5% by weight of the crude coal tar, and can be recovered by extraction of the chemical oil with aqueous alkali, e.g. a caustic solution. The aqueous layer is separated from the acid free oil, whereafter the phenols are reconverted to crude form by acidification of the aqueous solution (termed "springing"). The crude phenolics may then be fractionated to obtain phenol, cresols, and higher boiling phenolics such as xylenols.

Further fractions commonly taken in the distillation of coal tar are sometimes called "creosote" fractions or heavy oils, while coal tar pitch is recovered as a residue left behind from such a coal tar distillation.

This residual coal tar Pitch has itself proven to be a highly valuable item of commerce. Coal tar pitch is used for many purposes including, importantly, its use as a binder for carbon and graphite in the formation of carbon bodies and can, for example, be used in the production of anodes, cathodes, electrodes, etc. for use in the metal industry. For example such electrodes are used in electrolytic reduction processes such as aluminium reduction.

Historically, the processing of coal tar is a high volume industry and improvements which provide increased material yields from coal tar distillations while not adversely or unacceptably affecting other aspects of the rectification are highly valued.

SUMMARY OF THE INVENTION

One preferred embodiment of the present invention provides a process for obtaining an increased pitch yield from crude coal tar. The preferred process includes the steps of treating a crude coal tar material by reaction with formaldehyde, distilling the treated coal tar material and recovering therefrom an increased yield of coal tar pitch. This preferred process may be carried out, for example, by charging a crude coal tar material into a tank, adding formaldehyde to the tank and heating and agitating the formaldehyde-crude coal tar mixture, optionally in the presence of a catalyst, for a sufficient period of time to substantially react the formaldehyde with the crude coal tar material. The pre-reacted material may then be charged into a still and distilled under conventional conditions to leave a residual representing an increased yield of coal tar pitch as compared to the yield that would have been obtained had the crude coal tar material not been treated with the formaldehyde. Alternatively, of course, the treatment with formaldehyde may be conducted in the still itself prior to distillation of the crude coal tar material.

Another preferred embodiment of the present invention provides a coal tar pitch produced by the above process.

The process of the present invention thus provides coal tar pitch in increased yield which is highly suitable for use in the formation of anodes, cathodes and electrodes which are employed in the metal industry, as well as for many other uses ordinarily associated with coal tar pitch. Further, the present invention provides these improvements while not creating emissions, e.g. formaldehyde emissions, which are environmentally unacceptable and while not unacceptably affecting other aspects in the processing of the coal tar and its distillate fractions.

Additional objects, advantages and embodiments of the present invention will be apparent from the following description.

DESCRIPTION OF THE PREFERRED EMBODIMENT

For the purposes of promoting an understanding of the principles of the invention, reference will now be made to preferred embodiments and specific language will be used to describe the same. It will nevertheless be understood that no limitation of the scope of the invention is thereby intended, such alterations, further modifications and applications of the principles of the invention as being contemplated as would normally occur to one skilled in the art to which the invention pertains.

As mentioned above, one preferred embodiment of the present invention provides a process for obtaining an increased pitch yield from crude coal tar. In this regard, the term "crude coal tar" means coal tar that has not yet been distilled to remove the chemical oil fraction containing the tar acids. As such, the crude coal tar still contains the tar acids, which usually constitute between about 1 and 5 percent by weight of the coal tar, and more typically about 1–4 weight percent. In this regard, the monitoring of tar acid content in coal tars is a standard practice and those ordinarily skilled in the pertinent art are familiar with and will readily recognize the term "tar acids" which refers to a mixture of phenolic bodies present in crude coal tars and which are extractable by caustic solutions. The predominant components of tar acids are Phenol, cresols, and xylenols.

According to the invention, a material including this crude coal tar, optionally blended with a coal tar oil fraction such as heavy oil (usually less than 50% by weight relative to the crude coal tar), is treated by reaction with formaldehyde. Generally speaking, it is preferred that the formaldehyde reaction treatment step be performed effectively to provide at least a 1% (by weight) increase in the yield of pitch over that which is obtained absent the formaldehyde treatment. The increase in pitch yield will vary according to several factors including the amount of formaldehyde added, the temperature and duration of the treatment step, and the amount of tar acid present.

The formaldehyde can be added as a dry solid (i.e. as paraformaldehyde) or in an aqueous solution, and the reaction is preferably conducted under heat at a temperature sufficiently high to promote fluidity of the coal tar and its mixing and reaction with the formaldehyde. In this regard, preferred temperatures for this formaldehyde treatment step are at least about 40° C., and are more preferably about 50° C. to about 180° C. When formaldehyde is added in a solution, it will usually be a 20–60% aqueous solution, and especially from commercial sources may contain up to about 15% methanol to inhibit polymerization. These commercial grades are commonly known as "formalin".

The formaldehyde is preferably added to the crude coal tar material in an amount relative to the tar acid content of the crude coal tar material. The formaldehyde is advantageously added in at least about a 1:2 molar ratio with respect to the tar acids present, more preferably at least about a 1:1 molar ratio with respect to the tar acids present. In most cases, the preferred formaldehyde/tar acid molar ratio will fall in the range of about 1–4:2.

One practical way to determine how much formaldehyde to add is to determine the relative amounts of the different tar acids present in the crude coal tar supply. This is readily done by those in the area and in fact often will be a standard practice in any event. Knowing the ratios of the different tar acids with respect to each other, the approximate average molecular weight of the tar acids can be determined. For example, for the crude coal tar used in the Examples below, an average molecular weight of about 108 grams per mole was determined for the tar acids. With this 108 g/mole assumption and knowing the total tar acid content of the crude coal tar in hand, one can make a determination of the amount of formaldehyde to add to achieve a particular formaldehyde/tar acid molar ratio in accordance with this invention. For example, for a crude coal tar material containing 3.4% by weight tar acids, one calculates that to achieve a ratio of 1 mole of formaldehyde for every 2 moles of tar acid, about 0.5 weight percent of formaldehyde (dry) is needed (3.4 wt %×30 g formaldehyde per mole/108 g tar acid per mole x 1 mole formaldehyde/2 moles tar acid). Knowing the weight percent of formaldehyde in an aqueous solution when used, one can then readily calculate the amount of the aqueous solution which needs to be added. Table 1 below sets forth an illustration of approximately how much dry and 52% aqueous formaldehyde can be added to coal tars of varying tar acid content to achieve 1:1 molar ratios between formaldehyde and tar acid.

TABLE 1

Dry and 52% HCHO Requirements Per TA Concentration To Achieve 1:1 Molar Ratio*

| wt % TA of of tar charged | Dry HCHO wt % of tar charged | 52% HCHO wt % of tar charged |
|---|---|---|
| 0.5 | 0.14 | 0.27 |
| 1.0 | 0.28 | 0.54 |
| 1.5 | 0.42 | 0.81 |
| 2.0 | 0.56 | 1.08 |
| 2.5 | 0.70 | 1.35 |
| 3.0 | 0.84 | 1.62 |
| 3.5 | 0.98 | 1.88 |
| 4.0 | 1.12 | 2.15 |

*Based on average molecular weight of 108 g/mole for the Tar Acid (TA) and assuming two moles TA react with one mole HCHO.

As to the duration of the treatment by formaldehyde reaction, this will desirably be at least one hour, and even more desirably at least two hours, e.g. in the range of about 2 hours to a day, although there is not necessarily an upper limit to the duration of the pretreatment step; however, economics may direct that it not be excessively long. It is preferred that that formaldehyde coal tar mixture be agitated during this treatment. If desired, the formaldehyde reaction treatment can also be conducted in the presence of a catalyst for the condensation of formaldehyde with the tar acids. For instance, this treatment step may be conducted in the presence of an acid catalyst, e.g. HCl.

The distillation itself can be performed in a conventional manner, for example taking fractions that boil up to about 360° C. It is desirable to employ means to monitor and/or reduce any formaldehyde emissions which might occur, e.g. articles or devices for sensing formaldehyde and/or a scrubber can be employed if necessary.

Once the distillation is complete, the resulting pitch residue can be conventionally recovered. The modified pitch product has good qualities, and its softening point will vary in accordance with several factors including the particular coal tar material and processing steps used. Preferred pitches will have softening points in the range of about 60° to about 150° C., more preferably about 100° to about 120° C. The resulting pitch product is highly suitable for use as a binder in the formation of electrodes for use in the metal industry or in other conventional coal tar pitch applications.

For the purpose of promoting a greater appreciation of the invention and its preferred aspects and embodiments, the following specific Examples are provided. It will be understood that these Examples are illustrative and not limiting of the invention.

In the Examples, certain abbreviations are used. These have their usual art recognized meaning unless otherwise indicated. For example, "g" means grams, ° C. means degrees Celsius, % means percent and is based on weight unless otherwise indicated, S.P. means softening point, etc.

EXAMPLES 1-7, AND 8-11 (COMPARATIVE)

Several runs were performed in which crude coal tar was treated with formaldehyde prior to distillation to yield pitch. The coal tar had a tar acids content of 3.4% as measured by extraction with caustic. The formaldehyde was added as a 52% aqueous solution to achieve varying HCHO/Tar acid stoichiometric ratios. For example, assuming that one mole of HCHO condenses with two moles of tar acid, about 0.5% dry HCHO is the stoichiometric amount required based on 3.4% tar acids and assuming an average molecular weight of 108 g/mole for the tar acids. The results of these formaldehyde-based runs and comparative non-formaldehyde runs are set forth in Table 2. These results show the significant increase in pitch yield obtained by the invention. For example, the average yield (wt %) for inventive Examples 3-5 was 55.1%, whereas Examples 8-10, equivalent runs without formaldehyde, afforded an average yield of 52.2%. These results also show that particularly preferred processes can be performed by treating the coal tar with formaldehyde in excess of the stoichiometric amount (i.e. in greater than a 1:2 formaldehyde/tar acid molar ratio).

TABLE 2

| Ex. # | Tar (g)* | % Dry HCHO | Temp (°C.) | Time (Hrs) | Wt % Yield | S.P. (°C.) |
|---|---|---|---|---|---|---|
| 1 | 199.7 | 0.50 | 65-60 | 16 | 55.0 | 97.2 |
| 2 | 200.1 | 1.0 | 65-70 | 16 | 55.3 | 105.6 |
| 3 | 200.0 | 1.0 | 65-70 | 16 | 56.1 | 101.1 |
| 4 | 201.9 | 1.0 | 65-70 | 16 | 53.9 | 112 |
| 5 | 200.9 | 2.5 | 65-70 | 16 | 56.5 | 101.1 |
| 6 | 199.6 | 2.5 | 160-170 | 2 | 55.9 | 104.4 |
| 7 | 199.8 | 0.5 | 160-170 | 2 | 54.8 | 98.9 |
| 8 | 198.8 | None | 65-70 | 16 | 52.9 | 101.7 |
| 9 | 201.8 | None | 65-70 | 16 | 52.2 | 104.4 |
| 10 | 200.5 | None | 65-70 | 16 | 51.6 | 107 |
| 11 | 200.2 | None | Straight Dist. | — | 51.4 | 102.8 |

*This crude coal tar contained 3.4% tar acids by extraction

EXAMPLE 12

A large still was charged with 9546 gallons of crude coal tar at 55° C. 1100 pounds of formaldehyde (dry, i.e. paraformaldehyde) were added over about ½ hour and the mixture agitated and allowed to react for about 4½ additional hours at a temperature of about 55° to about 75° C. Thereafter, the still was fired and the crude coal tar material fractionally distilled in a conventional manner to leave a residue of coal tar pitch. A 62.5% weight yield of a 117° C. softening point pitch was realized from this process. The 62.5% yield was determined by innage and outage measurements of the tar charged and residue pitch. The increase in pitch yield was 3.7% over the expected 58.8% weight yield previously obtained in similar runs except without the formaldehyde treatment.

EXAMPLE 13

A large agitated tank was charged with coal tar. Formaldehyde was added as a 52% aqueous solution to the tank in about twice the stoichiometric ratio (i.e. in about a 1 to 1 molar ratio) with respect to the tar acids (1.42% by weight in the tar). This formaldehyde was added over a period of about two hours. Thereafter, the coal tar/formaldehyde mixture, at 51° F., was agitated for an additional 6 hour period. The formaldehyde treated coal tar was then charged into a series of stills over a 4 hour period. The distillation was begun and conducted under conventional conditions. Subsequent to the distillation, the residual coal tar pitch was recovered by blowing the stills into a pitch storage tank. At various points in the formaldehyde treatment and distillation, samples of the tar and the oil cuts were taken and analyzed for formaldehyde content. The pitch yield after distillation was 58.8%, representing a 2.6% increase over previous similar runs without formaldehyde treatment. Furthermore, the emission of formaldehyde and the overall effect of the formaldehyde treatment on the surrounding work environment and oil fractions were surprisingly low, thus providing another beneficial and unexpected aspect of the invention.

EXAMPLES 14-16

Three runs were performed in which mixtures of crude coal tar and heavy oil were treated with formaldehyde (0.25 weight % relative to the mixture) for about 16 hours at about 70° C. prior to distillation to yield pitch. The coal tar had a tar acid content of 1.58%. The results of these runs are set forth in Table 3 below, and similarly demonstrate an increased pitch yield over that obtained in similar runs except without the formaldehyde treatment.

TABLE 3

| Ex. | Total Charge (g) | Coal Tar (g) | Heavy Oil (g) | Pitch Yield |
|---|---|---|---|---|
| 14 | 501.7 | 401.2 | 100.5 | 53.62% |
| 15 | 501.0 | 398.7 | 102.3 | 52.46% |
| 16 | 500.3 | 350.8 | 149.5 | 50.75% |

While the invention has been described in detail in the foregoing description, the same is to be considered as illustrative and not restrictive in character, it being understood that only the preferred embodiment has been shown and described and that all changes and modifications that come within the spirit of the invention are desired to be protected.

What is claimed is:

1. A process for obtaining an increased pitch yield from crude coal tar, comprising treating a crude coal tar by reaction with formaldehyde, distilling said treated coal tar and recovering therefrom an increased yield of coal tar pitch over that obtained without said treating by reaction with formaldehyde.

2. The process of claim 1 wherein prior to the distillation the coal tar is pretreated with formaldehyde in at least about a 1:2 molar ratio with respect to the tar acid content of the coal tar for a period of at least one hour and at a temperature of at least about 40° C.

3. The process of claim 2 wherein prior to the distillation the coal tar is treated with formaldehyde in at least about a 1:1 molar ratio with respect to the tar acid content.

4. The process of claim 3 wherein prior to the distillation the coal tar is treated with formaldehyde for at least about two hours with agitation to promote the formaldehyde reaction with the crude coal tar.

5. The process of claim 4 wherein prior to the distillation the coal tar is treated with formaldehyde at a temperature in the range of about 50°-180° C.

6. The process of claim 5 wherein the pitch yield is increased by at least about 1% over that obtained without said treating by reaction with formaldehyde.

7. The process of claim 1 which includes the steps of mixing and heating the crude coal tar and the formaldehyde in a first tank, transferring the mixture to a still, distilling the mixture to leave a pitch residue in the still, and blowing the still to recover the pitch.

8. The process of claim 1 wherein the crude coal tar is crude coal tar or a mixture of crude coal tar and a coal tar distillate fraction.

9. A coal tar pitch product obtained by a process including the steps of treating a crude coal tar, by reaction with formaldehyde, distilling said treated coal tar, and recovering therefrom the pitch product.

10. The coal tar pitch product of claim 9 wherein prior to the distillation the coal tar is pretreated with formaldehyde in at least about a 1:2 molar ratio with respect to the tar acid content of the coal tar for a period of at least about one hour and a temperature of at least about 40° C.

11. The coal tar pitch product of claim 10 wherein prior to the distillation the coal tar is pretreated with formaldehyde in at least about a 1:1 molar ratio with respect to the tar acid content.

12. The coal tar pitch product of claim 11 wherein prior to the distillation the coal tar is treated with the formaldehyde for at least about two hours with agitation to promote the formaldehyde reaction with the crude coal tar material.

13. The coal tar pitch product of claim 12 wherein prior to the distillation the coal tar is treated with formaldehyde at a temperature in the range of about 50°-180° C.

* * * * *